United States Patent [19]

Harvill

[11] 4,014,461

[45] Mar. 29, 1977

[54] AUTOMATIC CHANGE-OVER DEVICE FOR LIQUID DISPENSING SYSTEM

[75] Inventor: William Andrew Harvill, Decatur, Ga.

[73] Assignee: The Coca-Cola Co., Atlanta, Ga.

[22] Filed: Mar. 10, 1976

[21] Appl. No.: 665,973

[52] U.S. Cl. ..... 222/94; 137/265

[51] Int. Cl.[2] ..... B65D 35/22

[58] Field of Search ..... 222/94, 105, 129, 129.1, 222/136; 137/111–114, 256, 265, 267, 398, 433, 572, 625.41; 244/135 R, 135 C

[56] References Cited

UNITED STATES PATENTS

| | | | |
|---|---|---|---|
| 2,170,136 | 8/1939 | Gavin | 137/114 |
| 2,929,535 | 3/1960 | Fairbanks | 222/136 X |
| 3,131,708 | 5/1964 | Knight | 137/113 |
| 3,825,027 | 7/1974 | Henderson | 137/265 |

*Primary Examiner*—Drayton E. Hoffman
*Assistant Examiner*—Joseph J. Rolla
*Attorney, Agent, or Firm*—W. Dexter Brooks

[57] ABSTRACT

An automatic change-over system for stock rotation of liquids packaged in plural collapsible bag-type reservoirs is described. The bag-type reservoirs are divided into primary and secondary groups, the primary group containing the supply of liquid being dispensed and the secondary group containing the liquid supply held in reserve. Automatic change-over between the primary and secondary groups of bag-type reservoirs is effected in response to a vacuum created by the empty condition in the bags in the primary group. The pressure change in the present system is the result of the deflation of the empty bag-type packages. Thus, the change-over is caused by the characteristics of the flexible bags containing the liquid being dispensed.

8 Claims, 3 Drawing Figures

AUTOMATIC CHANGE-OVER DEVICE FOR LIQUID DISPENSING SYSTEM

BACKGROUND OF INVENTION

1. Field of Invention

The present invention relates to a system for stock rotation of liquids, such as soft drink syrups, contained in collapsible bag-type reservoirs or replaceable packages. More specifically, the present invention relates to an automatic change-over device for automatically switching between a primary supply reservoir and a secondary supply reservoir in response to an empty condition of the primary reservoir.

2. Description of Prior Art

Heretofore the stock rotation or changing of liquid bag packages such as milk, soft drink syrups or chemicals, has been accomplished by manual methods. When a package became empty the pump system was not supplied with liquid until the packages could be manually changed. This caused unavoidable, unexpected and inconvenient delays in the dispensing operation. To provide for larger reserves many prior art systems connected packages in a parallel arrangement. This does not provide for the necessary stock rotation required by many perishable food items such as milk and soft drink syrups. By contrast, rigid types of sealed packages have inlet and outlet openings and are often connected in series. These too do not provide complete rotation of liquid products since mixing occurs. If bag packages were connected in series they would not provide for reserve capacity but only a large initial capacity, since the packages will collapse equally unless assisted by gravity or other external means.

Automatic change-over devices for non-viscous liquids disposed in open or vented rigid containers are known in the art. However, these devices are not satisfactory for automatic stock rotation of viscous liquids contained in flexible bag packages. Furthermore, many liquids tend to crystalize when exposed to air in open systems further complicating container rotation. Bag packages create a sealed and closed system to air and other outside contaminates.

For example, an automatic change-over system for gas contained in a primary and secondary bank of storage tanks is disclosed in U.S. Pat. No. 2,968,162 to Acomb issued Jan. 17, 1961. The Acomb system effects a change-over from one group of supply tanks to another in response to pressure changes caused by an empty condition of the tanks being dispensed. However, the Acomb system does not possess the necessary sensitivity to automatically dispense more viscous liquids, such as syrups, in a fast and reliable manner.

Another similar type of automatic change-over system is disclosed in U.S. Pat. No. 3,825,027 to Henderson. In the Henderson system, the change-over sensitivity is enhanced by the provision of ball float valves 34, 36 in the respective primary and secondary supply circuits. The Henderson system works very well for dispensing liquid fuels of low viscosity, this being the purpose for which it was designed. However, the float valves tend to stick due to sugar build-up when the liquid being dispensed is a viscous liquid such as soft drink syrups.

SUMMARY OF THE INVENTION

Accordingly, it is a primary object of the present invention to provide a device whereby two separate systems of single or multiple packages may be rotated automatically as they are empty, allowing for package changes to be made when time is available.

It is another object of the present invention to provide an automatic change-over device having the necessary sensitivity for dispensing viscous liquids such as syrup.

It is a further object of the present invention to provide an automatic change-over device suitable for dispensing liquids disposed in flexible bag reservoirs.

The objects of the present invention are fulfilled in part by virtue of the inventor's discovery that flexible bag packages, when connected in circuit with a positive displacement dispensing pump, deflate when empty and create a pressure drop or vacuum in the dispensing circuit. A similar pressure drop to a less acute degree will result from an empty rigid container. However, the deflation of a flexible bag package increases the rapidity of the pressure change as the bag becomes empty and makes the effect thereof much more acute than the pressure change caused by an empty rigid container. The inventor makes use of this discovery in the design of the change-over device of the present invention for dispensing viscous liquids such as soft drink syrups.

The change-over device consists of two internal check valves and a bypass valve. Each check valve is connected by passages to separate bag package systems. The bypass valve may be oriented to bypass the check valve connected to either of the bag systems and corresponding liquid circuits. A bag circuit whose check valve is bypassed is considered to be the "primary" circuit since the pump will draw liquid from this circuit first. The bag circuit which must flow through the check valve is known as the "secondary" circuit since the other circuit must be empty before the secondary circuit can be used.

The automatic change-over device of the present invention consists of simple mechanical components disposed within a common housing. The bypass valve includes a spool-type valve having bypass slots or through bores in circuit with the primary or secondary supplies depending on the position of rotation of the spool. The check valves include spring biased ball valves in circuit with each of the primary and secondary supply circuits which open or close in response to pressure differentials on opposite sides thereof. Proper and satisfactory functioning of these valve components is dependent upon the characteristics of the flexible bag packages in the supply circuits, as discussed hereinbefore.

BRIEF DESCRIPTION OF THE DRAWINGS

The objects of the present invention and the attendant advantages thereof will become more readily apparent by reference to the following drawings wherein.

DETAILED DESCRIPTION OF PREFERRED EMBODIMENTS

Figure 1:
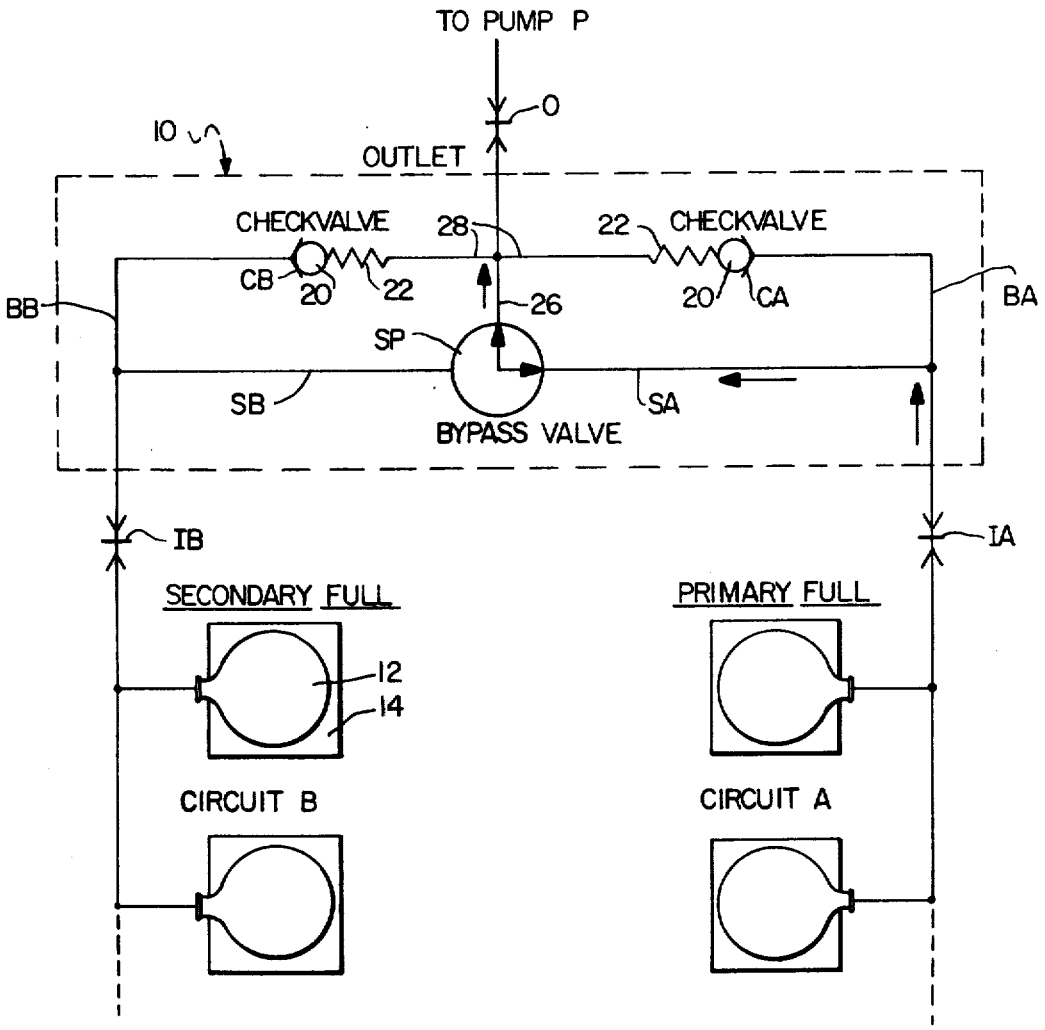
FIG. 1 is a diagrammatic view illustrating the dispensing system of the present invention with both the primary and secondary supply circuits in a full condition.

Referring in detail to FIG. 1, there is illustrated a primary supply reservoir of flexible bag packages generally designated circuit A. A similar set of bag packages comprise a secondary supply reservoir and are generally designated circuit B. In the condition shown, these packages are both full prior to the commencement of the dispensing operation.

Each of the bag packages include flexible bags 12 disposed within outer rigid boxes 14 of types that are well known in the art for containing milk, syrup or liquid chemicals of a similar nature.

The bag packages from primary circuit A or secondary circuit B, during a dispensing cycle, are selectively connected to a pump P at outlet O through an automatic change-over device generally indicated 10. Primary circuit A is connected to an inlet IA of automatic change-over device 10 and secondary circuit B is connected to an inlet IB of automatic change-over device 10.

Change-over device 10 includes a plurality of valve members connected in circuit between pump P and circuits A and B. These valve members include a bypass valve having a rotary spool SP to be described in more detail hereinafter with reference to FIG. 3 and a pair of pressure responsive check valves CA and CB connected in series with primary circuits A and B, respectively. The bypass valve also has bypass branches SA and SB and bore passages BA and BB connected in series circuit with pressure responsive check valves CA and CB, respectively.

Each of the valves CA and CB include a ball valve which is normally closed by a bias spring 22. These check valves are connected by a lateral passage 28 which communicates with spool SP through a central passage 26.

Figure 2:
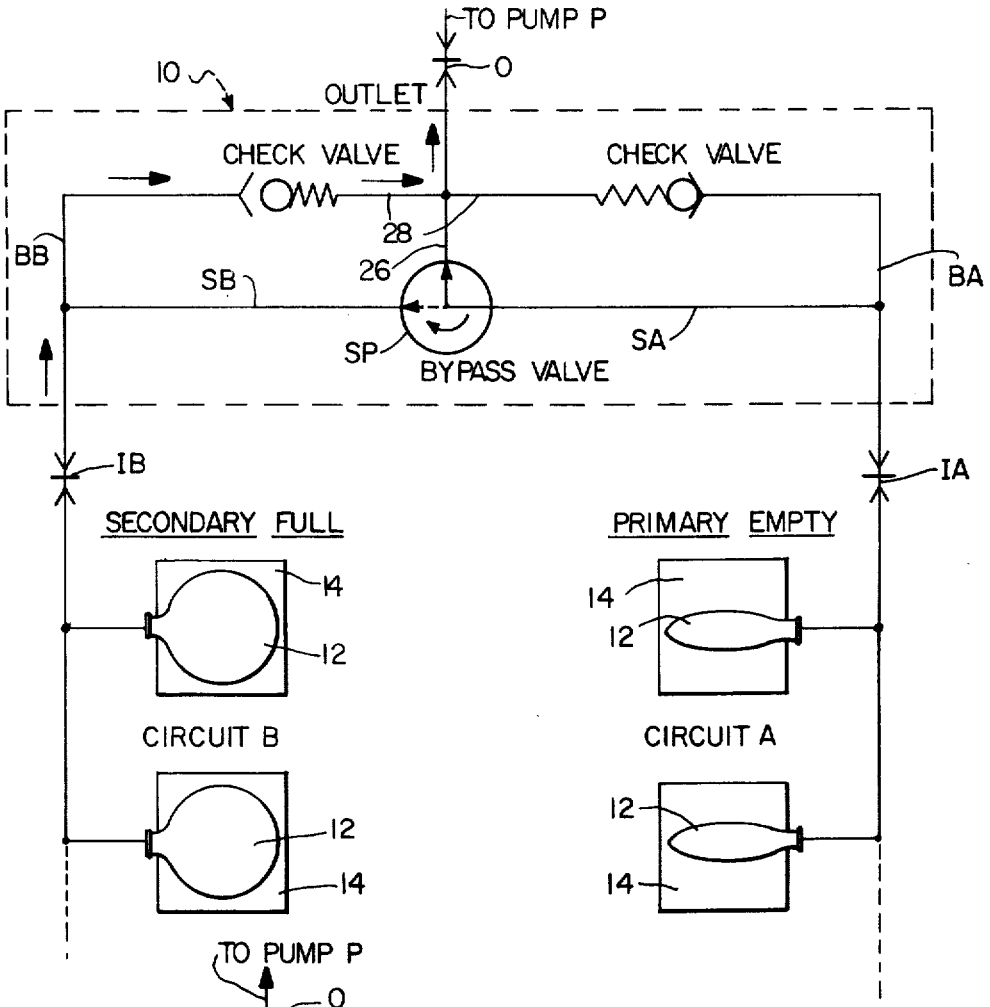
FIG. 2 is a diagrammatic view of the system of FIG. 1 illustrating the primary supply circuit in an empty condition and the secondary circuit in a full condition.

Referring in detail to FIG. 2 there is illustrated the identical system to FIG. 1 with the exception that the bags 12 in primary circuit A are in an empty state and are therefore deflated. As further illustrated in FIG. 2 the deflation of bags 12 in primary circuit A causes a significant pressure drop or vacuum in lateral and central passages 26 which causes ball 20 of check valve CB to open. Upon opening of check valve CB commencement of the flow of liquid from secondary circuit B is begun via inlet IB, bore BB, and check valve CB to outlet O. In this manner, as will be further described hereinafter, an automatic change-over from the primary circuit A to secondary circuit B is effected. At this point in time secondary circuit B then becomes the primary circuit and primary circuit A becomes the secondary circuit. Once this situation has stabilized spool SP is rotated for connection of lateral bore or slot SB and central passage 26. The liquids flowing from circuit B then take the path of least resistance which is through slot SB, spool SP, and central passage 26 to outlet O. While in this condition, the bag packages of what was primary circuit A can be refilled without having any detrimental effects on the dispensing cycle in progress.

Figure 3:
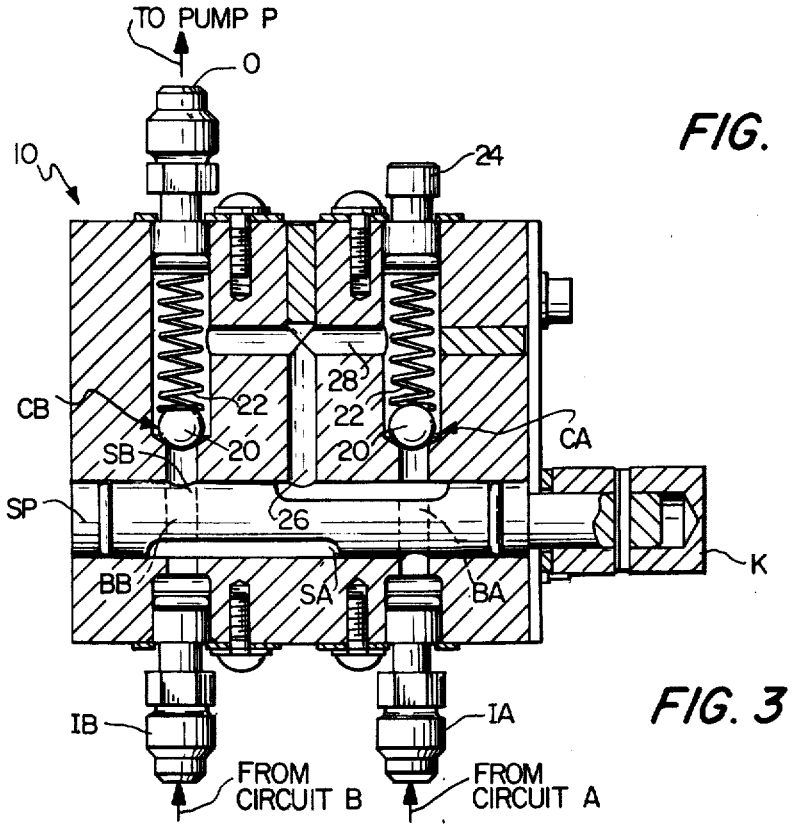
FIG. 3 is a cross-sectional view of the automatic change-over device of the present invention suitable for use in the systems of FIGS. 1 and 2.

The details of the assembly of the mechanical components of a preferred embodiment of the automatic change-over device 10 of FIGS. 1 and 2 is illustrated in detail in FIG. 3. As illustrated, this device includes a common block or housing containing the necessary internal bores or passages for selective connection of either inlet IA from circuit A or inlet IB from circuit B to outlet O connected to a dispensing pump P. Disposed within a lateral passage or bore is a rotary spool valve SP which may be rotated to selective dispensing positions by the knob K. Spool SP includes a pair of bypass slots SA, SB, for selectively bypassing the check valves CA and CB respectively. For example, in the position shown bypass slot SA bypasses the flow of liquid from inlet IA through central bore 26 and lateral bore 28 to outlet O. Thus in this position no liquid from circuit A flows through check valve CA. In a similar manner by rotating spool SP 180° bypass slot SB may be utilized to bypass fluid around check valve CB.

As further illustrated in FIG. 3, the check valves CA and CB are disposed in vertical bores or passages in substantial alignment with bores BA and BB respectively in spool SP. Check valves CA and CB are likewise connected by a lateral passage 28 which forms a T with central passage 26. During automatic change-over from circuit A to circuit B or vice versa the flow path of liquid dispensed is directly through either of bores BA, BB and the corresponding check valve in alignment therewith. The bore in which check valve CA is disposed is filled with a plug 24. This plug may be removed to change or replace check valve CA. Likewise outlet connection O may be removed to change or replace check valve CB.

DESCRIPTION OF OPERATION

One can readily understand the operation of the automatic change-over device in the system of the present invention by reference to FIGS. 1 and 2. In FIG. 1 both the primary circuits A and the secondary circuit C are full. In this condition the dispensing pump P easily removes liquid from primary circuit A through bypass valve spool SP in the position shown since there is no major obstruction or pressure working in opposition to pump P. Also in this position it can be readily observed that the secondary circuit B is obstructed by closed check valve CB. The pump P will continue to operate only from the primary circuit A until all liquid is removed. Referring to FIG. 2 when primary circuit A empties the bags 12 thereof collapse and the pump P in conjunction with the collapsed state of bags 12 creates a substantial pressure decrease or vacuum in lateral passage 28. Since check valve CB is in direct communication with lateral passage 28, this vacuum back biases ball 20 against spring 22 in check valve CB and thereby opens check valve CB. Once check valve CB opens liquid from the bag packages in circuit B, which was initially the secondary circuit, can be pumped through outlet O via inlet IB, bore BB, check valve CB, passage 28 and outlet connection O.

During routine stock inventory or inspection of the bag packages, an attendant would become aware of the collapsed or empty state of bags 12 in what was the primary circuit A. The bypass valve spool SP would then be rotated to change the primary designation and logic to circuit B. Circuit B now becomes the primary circuit and spool SP is rotated to the position shown in phantom in FIG. 2. This bypasses check valve CB. The attendant can then remove the empty bag packages from circuit A without affecting the operation of the dispensing system in any way. New packages may be connected in circuit A when convenient and when connected become the secondary supply of liquid to be dispensed.

In a similar manner described hereinbefore with reference to check valve CB, when the packages of circuit B become empty and collapse into a deflated state check valve CA will open in response to the vacuum created in lateral passage 28 and connect the flexible bag packages of circuit A through outlet O to pump P. The process may be repeated over and over again by switching the primary side with the bypass valve spool SP and changing the respective bag packages in circuits A or B.

It should be understood that the system described herein may be modified as would occur to one of ordinary skill in the art without departing from the spirit and scope of the present invention.

What is claimed is:

1. An automatic change-over device for a liquid dispensing system comprising:

first and second sets of at least one collapsible bag for containing a liquid to be dispensed, each of said collapsible bags having a first volume when full and deflating to a second volume when empty;

pump means for drawing said liquid out of said first or second sets of collapsible bags when in circuit with said first or second sets, respectively;

first pressure sensitive valve means in circuit between said first set of bags and said pump means, said first pressure sensitive valve means being normally closed and being opened in response to a pressure change created by said second volume of said second set of bags;

second pressure sensitive valve means in circuit between said second set of bags and said pump means, said second pressure sensitive valve means being normally closed and being opened in response to a pressure change created by said second volume of said first set of bags; and bypass valve means for selectively connecting either said first or second sets of bags to said pump means in parallel with either said first or second pressure sensitive valve means, respectively.

2. An automatic change-over device as defined in claim 1 wherein said first and second pressure sensitive valve means each include ball elements biased to normally closed positions by spring means.

3. An automatic change-over device as defined in claim 1 wherein said bypass valve means comprises a rotatable valve element having a first channel means for selectively connecting said first set of bags to said pump means directly through said first pressure sensitive valve means or directly to said pump means in parallel with said first pressure sensitive valve means, and a second channel means in said valve element for selectively connecting said second set of bags to said pump means directly through said second pressure sensitive valve means or directly to said pump means in parallel with said second pressure sensitive valve means.

4. The automatic change-over as defined in claim 1 wherein said bypass valve is a rotary spool valve.

5. The automatic change-over device as defined in claim 1 wherein said pressure sensitive valve means and bypass valve means are disposed in a common housing having first and second inlet passages coupled to said first and second sets of bags, respectively, and an outlet passage containing said second pressure sensitive valve means and coupled to said pump means, said housing further including:

a first bore extending transversely of and intersecting said first and second inlet passages, said bypass valve means being disposed in said first bore;

a second bore disposed substantially parallel to said outlet passage, said second bore containing said first pressure sensitive valve means;

a third bore in said housing connecting said outlet passage and said second bore; and a fourth bore in said housing connecting said first bore and said third bore;

whereby said bypass valve means selectively connects either said first inlet passage or said second inlet passage to said pump means through said fourth bore, said third bore, and said outlet passage.

6. An automatic change-over device for a fluid dispensing system comprising:

housing means having first and second inlet passages and an outlet passage for passing fluid from said inlet passages to a load device;

a first bore in said housing extending transversely of and intersecting said first and second inlet passages;

a second bore in said housing disposed substantially parallel to said outlet passage;

a third bore in said housing connecting said outlet passage and said second bore;

a fourth bore in said housing connecting said first bore and said third bore;

a rotatable cylindrical valve element journalled in said first bore, said rotatable valve element having a first channel means therein for selectively connecting said first inlet passage with either said fourth and second bores or said second bore alone, and said second channel means therein for selectively connecting said second inlet passage with either said outlet passage and said fourth bore or said outlet passage alone;

first pressure sensitive valve means disposed in said second bore having a normally closed position for precluding the direct flow of fluid from said first inlet passage to said second bore, said first valve means opening in response to a predetermined pressure differential across said first valve means;

second pressure sensitive valve means in said outlet passage having a normally closed position for precluding the direct flow of fluid from said second inlet passage to said outlet passage, said second valve opening in response to a predetermined pressure differential across said second valve means; and means for rotating said cylindrical valve element to selectively connect either said first inlet passage with said fourth bore or said second inlet passage with said fourth bore.

7. The automatic change-over device of claim 6 wherein each of said first and second channel means in said cylindrical valve element comprises a slot in the surface of said cylindrical element and a diametric bore through said cylindrical element in communication with said slot, the slot of said first channel means connecting said first inlet passage with said fourth bore in one selected position of said cylindrical valve element, the slot of said second channel means connecting said second inlet passage with said fourth bore in another selected position of said cylindrical valve element.

8. The automatic change-over device of claim 6 wherein said first and second pressure sensitive valve means each include ball elements bias to normally closed positions by spring means.

* * * * *